US008305012B2

(12) United States Patent
Ko et al.

(10) Patent No.: US 8,305,012 B2
(45) Date of Patent: Nov. 6, 2012

(54) LIGHT-EMITTING ADJUSTMENT METHOD AND DISPLAY DEVICE

(75) Inventors: Chien-Ming Ko, Hsin-Chu (TW); Hung-Ching Lee, Hsin-Chu (TW); Chih-Fu Hsu, Hsin-Chu (TW); Yueh-Han Li, Hsin-Chu (TW)

(73) Assignee: Au Optronics Corp., Hsin-Chu (TW)

( * ) Notice: Subject to any disclaimer, the term of this patent is extended or adjusted under 35 U.S.C. 154(b) by 336 days.

(21) Appl. No.: 12/786,680

(22) Filed: May 25, 2010

(65) Prior Publication Data

US 2011/0084621 A1 Apr. 14, 2011

(30) Foreign Application Priority Data

Oct. 9, 2009 (TW) ..... 98134377 A

(51) Int. Cl.
*H05B 37/02* (2006.01)

(52) U.S. Cl. ..... 315/307; 315/250; 315/360

(58) Field of Classification Search ..... 315/185 R, 315/247, 291, 294, 299, 302, 307, 312, 360, 315/250

See application file for complete search history.

(56) References Cited

U.S. PATENT DOCUMENTS

| | | | | |
|---|---|---|---|---|
| 7,425,943 | B2 | 9/2008 | Furukawa | |
| 7,719,208 | B2 * | 5/2010 | Li et al. | 315/307 |
| 8,106,608 | B2 * | 1/2012 | Ku | 315/360 |
| 2007/0024213 | A1 * | 2/2007 | Shteynberg et al. | 315/291 |
| 2008/0203946 | A1 | 8/2008 | Ito et al. | |
| 2010/0079071 | A1 * | 4/2010 | Shibata et al. | 315/77 |
| 2010/0194308 | A1 * | 8/2010 | Zhao et al. | 315/297 |

* cited by examiner

*Primary Examiner* — Tung X Le
(74) *Attorney, Agent, or Firm* — Chun-Ming Shih

(57) ABSTRACT

A light-emitting adjustment method and a display device are provided. The display device includes a voltage source, a light-emitting diode array, a pulse width modulator, a current sensor and a light-emitting adjuster. The voltage source provides an operating voltage. The pulse width modulator provides operating pulse signals to multiple light-emitting diodes arranged in column in order. The current sensor senses a plurality of overall current values of the light-emitting diodes at different timings during the light-emitting diodes are sequentially enabled. The light-emitting adjuster computes an operating current value of each of the light-emitting diodes according to the overall current values and performs a compensation operation based on the operating current value to obtain and output a compensation signal.

23 Claims, 8 Drawing Sheets

LIGHT-EMITTING ADJUSTMENT METHOD AND DISPLAY DEVICE

CROSS-REFERENCE TO RELATED APPLICATIONS

This application is based upon and claims the benefit of priority from the prior Taiwan Patent Application No. 098134377, filed Oct. 9, 2009, the entire contents of which are incorporated herein by reference.

BACKGROUND

1. Technical Field

The present invention generally relates to display devices with light-emitting diode arrays and, particularly to a light-emitting adjustment method and a display device both of that can adjust an operating pulse signal of each light-emitting diode.

2. Description of the Related Art

Referring to FIG. 7, showing a circuit diagram of a display device associated with the prior art. As illustrated in FIG. 7, a display device 700 includes n number of light-emitting diode columns $L_1$-$L_n$. Each of the light-emitting diode columns $L_1$-$L_n$ includes m number of light-emitting diodes $LED_1$-$LED_m$. Taking the light-emitting diode column $L_1$ for explanation, the light-emitting diodes $LED_1$-$LED_m$ are in parallel electrically connected to a voltage source 702 to receive an operating voltage from the voltage source 702. Each of the light-emitting diodes $LED_1$-$LED_m$ and the voltage source 702 has a current sensor 704 electrically connected therebetween. The current sensors 704 are respectively used for detecting operating current values of the light-emitting diodes $LED_1$-$LED_m$ and transmitting the obtained operating current values to analog-to-digital (A/D) converters 706.

Each of the A/D converters 706 converts the received operating current value from analog format to digital format and then outputs the digital operating current value to a driving circuit (not shown) of the display device 700. The light-emitting diodes $LED_1$-$LED_m$ each receive an operating pulse signal. The enabled order/sequence of the light-emitting diodes $LED_1$-$LED_m$ is decided by the received operating pulse signals. However, in the prior art, every light-emitting diode in each light-emitting area of the display device 700 needs a current sensor so as to detect the operating current value. Thus, the current sensors are too many so that bringing a high cost. If attempting to allow a plurality of light-emitting diodes to use a common current sensor, the detected current value will be the sum of operating current values of the respective light-emitting diodes with the common current sensor, which results in lighting on/off control only can apply a whole light-emitting area composed of the light-emitting diodes rather than each of the light-emitting diodes for brightness adjustment. As a result, the accuracy of brightness adjustment is lowered.

BRIEF SUMMARY

Accordingly, the present invention is directed to a light-emitting adjustment method, which can calculate out an operating current value of each light-emitting diode to obtain a current compensation value and then drive the light-emitting diode with the compensation value.

The present invention further is directed to a display device, which senses and records current values of each group/column of light-emitting diodes of a backlight thereof or the display device at the prerequisite of using light-emitting time intervals among the light-emitting diodes.

A light-emitting adjustment method in accordance with an embodiment of the present invention is adapted for a light-emitting diode array. The light-emitting diode array includes n number of light-emitting diode columns (e.g., $L_1$~$L_n$). Each of the light-emitting diode columns includes m number of light-emitting diodes (e.g., $LED_1$~$LED_m$) electrically connected in parallel and constituting a light-emitting area, n and m both are positive integers. The light-emitting adjustment method includes the following steps of: (1) providing an operating voltage to each of the m number of light-emitting diodes; (2) sequentially providing operating pulse signals to the m number of light-emitting diodes; (3) sequentially enabling (i.e., generally lighting on) the m number of light-emitting diodes according to the operating voltage and the respective operating pulse signals, sensing a plurality of overall current values flowing the m number of light-emitting diodes at different timings, and calculating an operating current value of each of the m number of light-emitting diodes according to the overall current values; (4) performing a compensation operation according to each of the operating current values and thereby obtaining a compensation signal; and (5) adjusting the corresponding operating pulse signal according to the compensation signal.

In one embodiment of the present invention, the step of sensing a plurality of overall current values flowing the m number of light-emitting diodes at different timings includes: during the m number of light-emitting diodes being sequentially enabled, sensing one of the overall current values, an objective(s) being enabled of the m number of light-emitting diodes, and the amount of enabled light-emitting diode at each of the different timings.

In one embodiment of the present invention, the step of calculating an operating current value of each of the m number of light-emitting diodes according to the overall current values includes: obtaining the operating current value of each of the m number of light-emitting diodes by calculation according to the overall current values, corresponding enabled objectives, and corresponding amounts of enabled light-emitting diode.

In one embodiment of the present invention, the step of performing a compensation operation according to each of the operating current values and thereby obtaining a compensation signal includes: obtaining the compensation signal by comparing each of the operating current values with a reference current value; when the operating current value is larger than the reference current value, the compensation signal is used for shortening a duty cycle of the operating pulse signal; and when the operating current value is smaller than the reference current value, the compensation signal is used for prolonging the duty cycle of the operating pulse signal.

A display device in accordance with another embodiment of the present invention is provided. The display device includes a voltage source, a light-emitting diode array, a pulse width modulator, at least a current sensor and a light-emitting adjuster. The voltage source provides an operating voltage. The light-emitting diode array includes n number of light-emitting diode columns, and each of the light-emitting diode columns includes m number of light-emitting diodes electrically connected in parallel and further electrically connected to the voltage source for receiving the operating voltage, n and m both are positive integers. The pulse width modulator is electrically connected to each of the m number of light-emitting diodes of each light-emitting diode column and for sequentially providing operating pulse signals to the m number of light-emitting diodes. The current sensor is electrically connected between a voltage output terminal of the voltage source and a voltage input terminal of the in parallel connected light-emitting diodes in each of the light-emitting diodes columns. The current sensor is used for sensing a plurality of overall current values flowing the m number of light-emitting diodes at different timings during the m number of light-emitting diodes being sequentially enabled. The light-emitting adjuster is electrically connected to the current sensor and the pulse width modulator. The light-emitting adjuster calculates an operating current value of each of the m number of light-emitting diodes according to the overall current values, performs a compensation operation according to the operating current value of each of the m number of light-emitting diodes to obtain a compensation signal, and then output the compensation signal.

In one embodiment of the present invention, the light-emitting adjuster obtains the operating current value of each of the m number of light-emitting diodes by calculation based on the overall current values, corresponding objectives being enabled in the m number of light-emitting diodes at the different timings, and corresponding amounts of enabled light-emitting diode in the m number of light-emitting diodes at the different timings.

The above-mentioned embodiments in accordance with the present invention use a common current sensor for each m number of light-emitting diodes, and therefore the number of current sensor is reduced. In addition, since the embodiments establish light-emitting time intervals among the m number of light-emitting diodes, current compensation values of the respective light-emitting diodes can be readily obtained by a compensation operation performed after sensing and recording overall current values of each group/column of light-emitting diodes of the backlight of the display device or the display device and then calculating out the operating current value of each light-emitting diodes according to the overall current values. Consequently, the light-emitting diodes can be driven by the respective compensation values to achieve the purpose of brightness adjustment.

BRIEF DESCRIPTION OF THE DRAWINGS

The accompanying drawings are included to provide a further understanding of the invention, and are incorporated in and constitute part of this specification. The drawings illustrate embodiments of the invention and, together with the description, serve to explain the principles of the invention.

DETAILED DESCRIPTION

Figure 1:
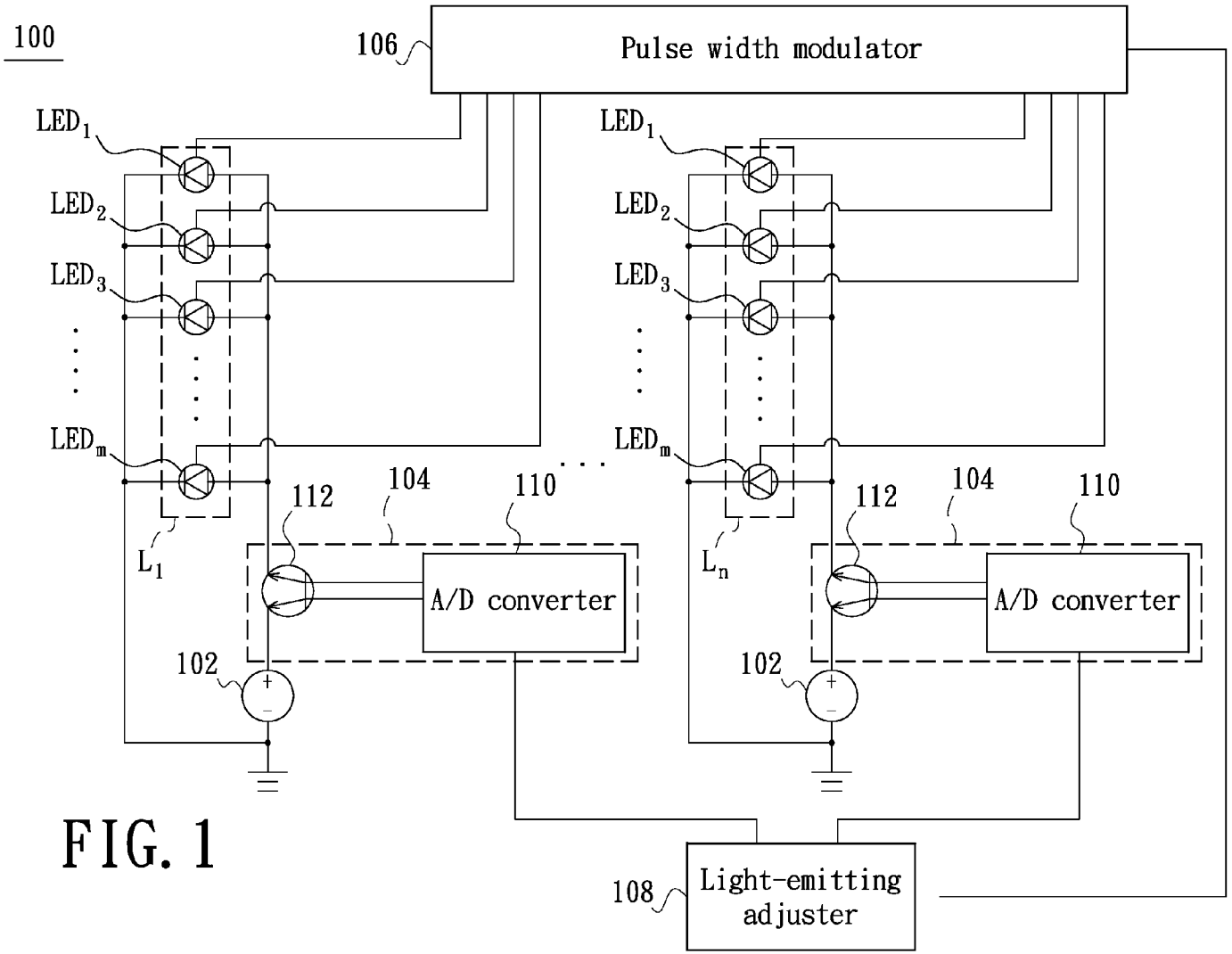
FIG. 1 shows a circuit diagram of an exemplary display device of the present invention.

Referring to FIG. 1, showing a circuit diagram of an exemplary display device of the present invention. In the illustrated embodiment, a display device 100 includes a plurality of voltage sources 102, a plurality of current sensors 104, a pulse width modulator 106, a light-emitting adjuster 108 and n number of light-emitting diode columns $L_1$-$L_n$. The display device 100 is for example a liquid crystal display device, a liquid crystal television, a notebook computer, an electronic device with liquid crystal material, but not limited to the present invention.

Each of the voltage sources 102 has two terminals, one of the terminals is used as a voltage output terminal and electrically connected to a corresponding one of the light-emitting diode columns $L_1$-$L_n$, for providing an operating voltage, and the other terminal of each of the voltage sources 102 is electrically connected to a ground potential, i.e., grounded.

Herein, the n number of light-emitting diode columns $L_1$-$L_n$ constitute a light-emitting diode array of the display device 100. Each of the light-emitting diode columns $L_1$-$L_n$ includes m number of light-emitting diodes $LED_1$-$LED_m$ electrically connected in parallel. As illustrated in FIG. 1, a voltage input terminal of each the light-emitting diodes $LED_1$-$LED_m$ is electrically connected to one terminal of the voltage source 102, i.e., the voltage output terminal of the voltage source 102 to receive the operating voltage, and another terminal of each the light-emitting diodes $LED_1$-$LED_m$ is electrically connected to the ground potential.

In the illustrated embodiment, both of n and m are integers above 0. In addition, the light-emitting diode array can be consisted of two or more than two light-emitting diode columns $L_1$-$L_n$, but not to limit the present invention.

The pulse width modulator 106 is electrically connected to each of the light-emitting diode $LED_1$-$LED_m$ for sequentially providing operating pulse signals to the light-emitting diodes $LED_1$-$LED_m$.

Each of the current sensors 104 is electrically connected between the voltage output terminal of the voltage source 102 and the voltage input terminal of each of the light-emitting diodes $LED_1$-$LED_m$ in a corresponding one of the light-emitting diode columns $L_1$-$L_n$. The current sensor 104 is for sensing a plurality of overall/total current values of the light-emitting diodes $LED_1$-$LED_m$ at different timings during the light-emitting diodes $LED_1$-$LED_m$ are sequentially enabled by the respective operating pulse signals. The current sensor 104 includes a sensing device 112 and an A/D converter 110. The sensing device 112 is electrically connected between the voltage output terminal of the voltage source 102 and the voltage input terminal of each of the light-emitting diodes $LED_1$-$LED_m$. The sensing device 112 detects overall current values of the light-emitting diodes $LED_1$-$LED_m$ at the different timings, and outputs the detected analog overall current values to the A/D converter 110. The A/D converter 110 converts the analog overall current values respectively to digital overall current values, and outputs the digital overall current values to the light-emitting adjuster 108.

The light-emitting adjuster 108 is connected to the current sensors 104 and the pulse width modulator 106. The light-emitting adjuster 108 receives the overall current values detected by the current sensors 104 at different timings, and calculates the operating current value of each of the light-emitting diodes $LED_1$-$LED_m$ based on the received overall current values. Then, the light-emitting adjuster 108 performs a compensation operation according to the operating current value of each the light-emitting diode to obtain a compensation signal, and outputs the compensation signal to the pulse width modulator 106. The pulse width modulator 106 adjusts the content (e.g., duty cycle) of the operating pulse signal of each of the light-emitting diodes $LED_1$-$LED_m$ according to the corresponding compensation signal.

In the illustrated embodiment, the compensation operation is used for obtaining the compensation signal by comparing the operating current value with a reference current value. The reference current value generally is selected from a current value representative of dark region brightness, a current value representative of bright region brightness, and a current value representative of target brightness.

Figure 2:
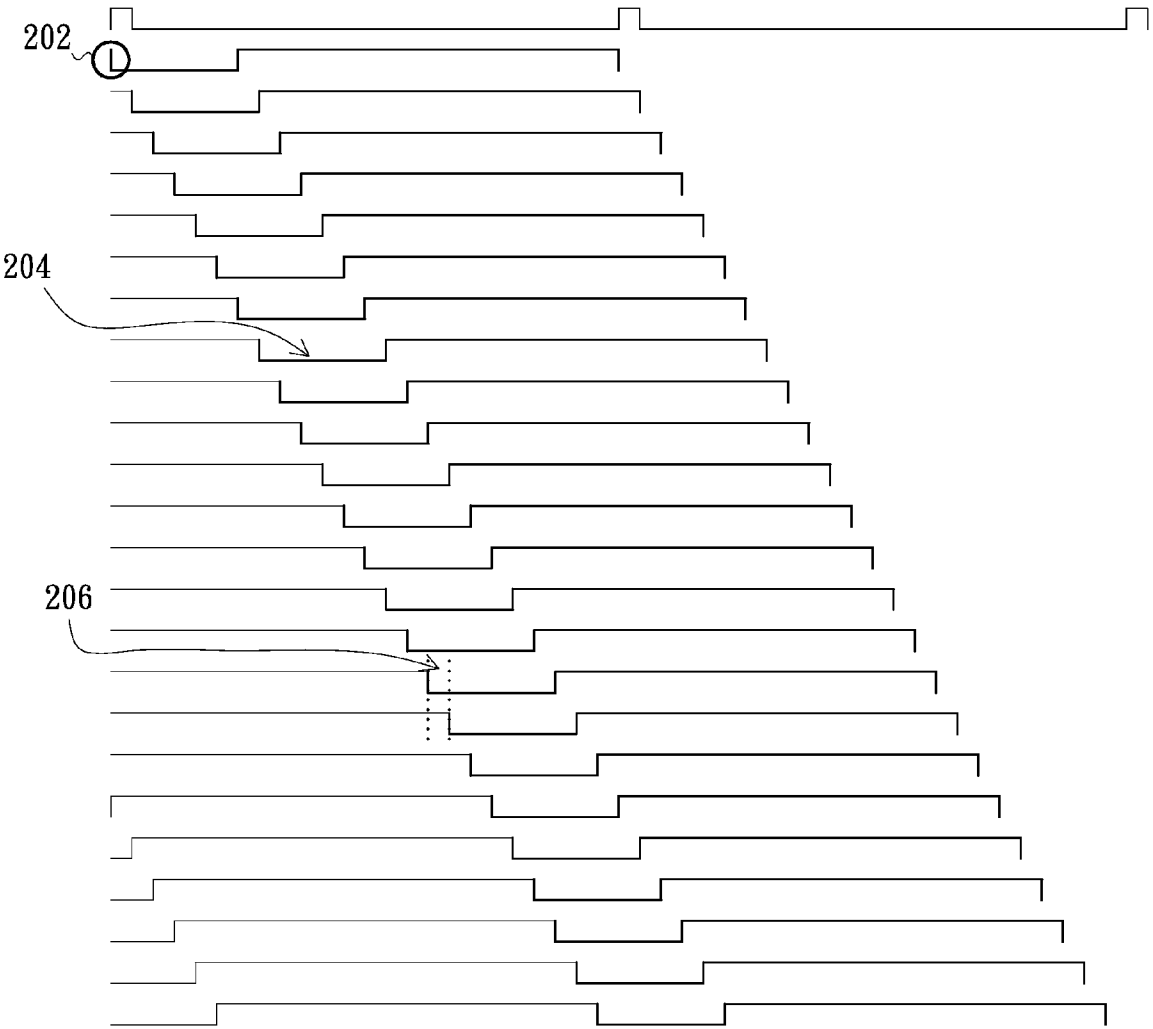
FIG. 2 shows timing diagrams of exemplary operating pulse signals of the present invention.

Referring to FIG. 2, showing timing diagrams of exemplary operating pulse signals associated with the present invention. Referring to FIGS. 1 and 2 together, when taking the light-emitting diode column $L_1$ for explanation, in FIG. 2, twenty-four operating pulse signals (where, m is assumed to be twenty-four) are taken for the purpose of illustration, but not to limit the present invention.

In the illustrated embodiment, the first pulse signal in FIG. 2 is a clock pulse signal of the light-emitting diode column $L_1$. The second pulse signal in FIG. 2 is an operating pulse signal (hereinafter also referred to as first operating pulse signal) transmitted to the light-emitting diode $LED_1$ from the pulse width modulator 106, the third pulse signal is an operating pulse signal transmitted to the light-emitting diode $LED_2$ from the pulse width modulator 106. The rest pulse signals are followed by analogy. Taking the first operating pulse signal for explanation, the first operating pulse signal begins/starts from the beginning time point 202 and runs until the falling-edge of logic high thereof. The light-emitting diode $LED_1$ is enabled (i.e., lighted on) in the logic high period of the first operating pulse signal. That is, although the voltage source 102 continually provides the operating voltage to the light-emitting diode $LED_1$ after the display device 100 being enabled, whether the light-emitting diode $LED_1$ is enabled or not is decided by the logic state of the first operating pulse signal. Taking the eighth operating pulse signal as an example, the light-emitting diode $LED_8$ is disabled in the logic low period 204. It can be concluded from FIG. 2 that, in each two neighboring operating pulse signals arranged in different rows, the latter operating pulse signal is later than the previous operating pulse signal with a delay time interval. That is, after the pulse width modulator 106 outputs the sixteenth operating pulse signal for the light-emitting diode $LED_{16}$, there is a preset time interval (e.g., the delay time interval 206) is existed before the seventeenth operating pulse signal for the light-emitting diode $LED_{17}$ is outputted. The delay time interval between neighboring rows is determined by a frame period of the display device 100 and the number of rows in each light-emitting diode columns. That is, in terms of FIG. 2, the first light-emitting diode $LED_1$ and the twenty-fourth light-emitting diode $LED_{24}$ have a time interval with twenty-three delay time intervals 206.

Figure 3:
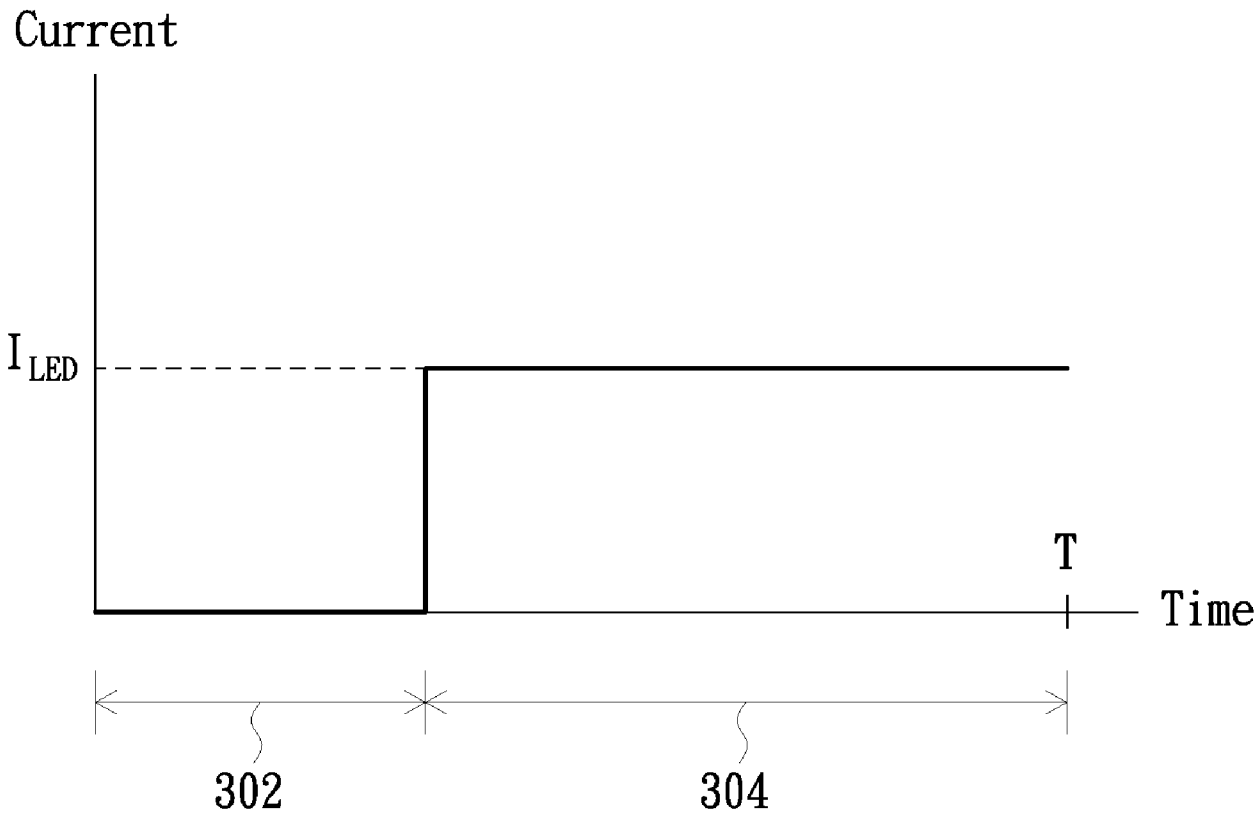
FIG. 3 shows a time-current relationship diagram of an operating pulse signal of a single light-emitting diode in accordance with an embodiment of the present invention.

Referring to FIG. 3, showing a time-current relationship diagram of an operating pulse signal of a single light-emitting diode in accordance with an embodiment of the present invention. In FIG. 3, the vertical axis represents the current value of the light-emitting diode, the horizontal axis represents the time intervals of light-emitting diode being enabled (i.e., lighted on) and disabled (i.e., turned off). The light-emitting diode is disabled in the time interval 302 and is enabled in the time interval 304. Thus, from the current change along the vertical axis, it can be concluded that in the time interval 302, the current value detected by the current sensor 104 in FIG. 1 approximately is 0; and in the time interval 304, the current value detected by the current sensor 104 rises to a current $I_{LED}$. Therefore, based on the relationship shown in FIG. 3, a time function of the operating current value of light-emitting diode is calculated by the following expression:

$$I_{LED_i}(t)=\text{Duty}(t)\times I_{LED_i}$$

Where, $I_{LED}$ is an operating current value, i is the serial number of the light-emitting diode, t is a sampling time point applied to the operating pulse signal, Duty(t) is 0 when the t is in the time interval 302, and Duty(t) is 1 when the t is in the time interval 304.

In a preferred embodiment of the present invention, when the operating current value is larger than the reference current value in the light-emitting adjuster 108, the duty cycle of the operating pulse signal provided by the pulse width modulator 106 is shortened. On contrary, when the operating current value is smaller than the reference current value, the duty cycle of the operating pulse signal provided by the pulse width modulator 106 is prolonged.

Figure 4A:
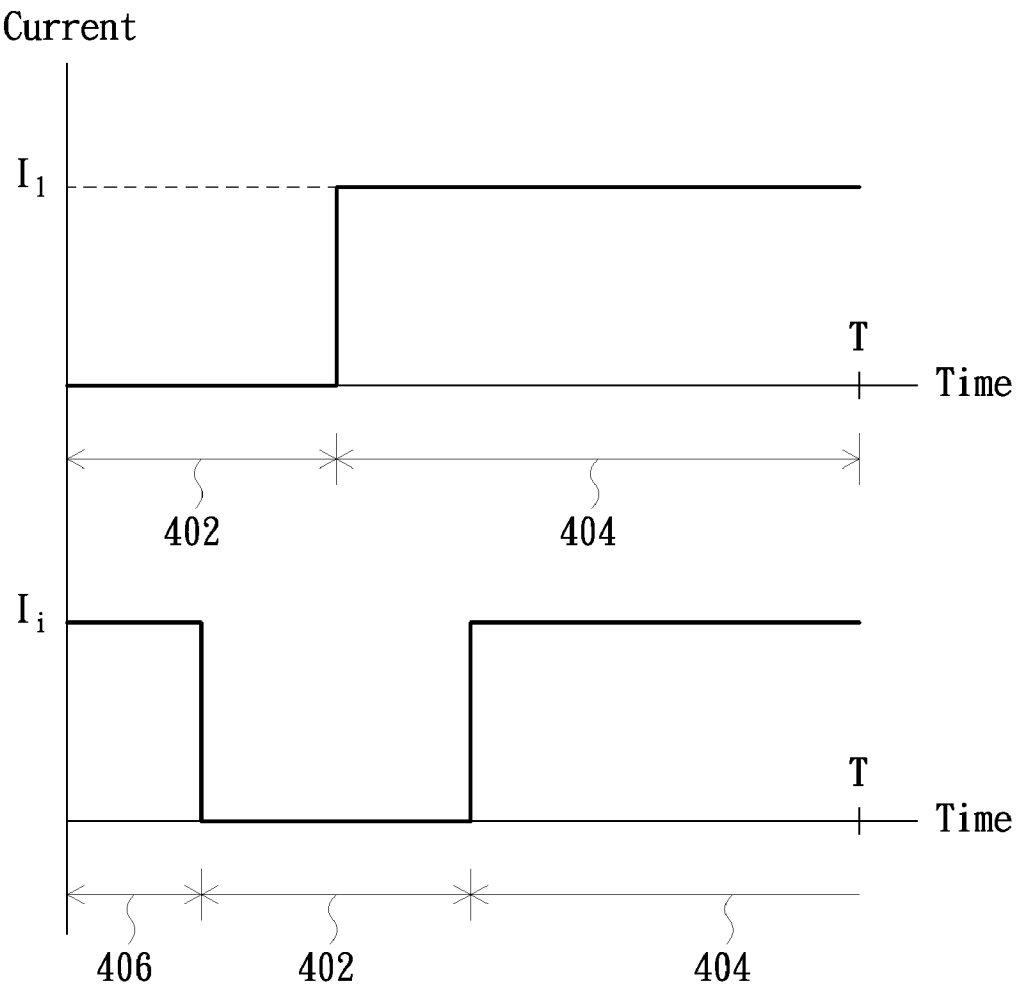
FIG. 4A shows time-current relationship diagrams of operating pulse signals of two neighboring light-emitting diodes in accordance with an embodiment of the present invention.

Referring to FIG. 4A, showing time-current relationship diagrams of the operating pulse signals of two neighboring light-emitting diodes arranged in different rows in accordance with an embodiment of the present invention. In the display device 100 as illustrated in FIG. 1, in order to calculate out the operating current value of each light-emitting diode, the operating pulse signals (as illustrated in FIG. 2) are sequentially provided to the light-emitting diodes for obtaining a plurality of overall current values, and the operating pulse signals outputted by the pulse width modulator 106 in FIG. 1 are given a delay time interval 406 between each two neighboring rows. Taking two neighboring operating pulse signals as an example, the previous operating pulse signal has time intervals 402 and 404, the previous light-emitting diode is disabled in the time interval 402 and enabled in the time interval 404. The latter operating pulse signal has time intervals 402, 404 and 406, the latter light-emitting diode is disabled in the time interval 402 and enabled in the time interval 404. The time interval 406 is a delay time interval with respect to the previous light-emitting diode and thus should not be included in the calculation of the operating current value of the light-emitting diode. Therefore, when calculating the operating current value, the time interval 406 should be deducted/subtracted from the sampling time point for the operating pulse signal. Accordingly, based on the relationship shown in FIG. 4A, a time function of the operating current value is calculated by the following expression:

$$I_{LED_i(t)}=\text{Duty}\left(t-\frac{i-1}{l}\right)\times I_{LED_i}$$

Where, $I_{LED}$ is an operating current value, i is the serial number of the light-emitting diode, t is a sampling time point applied to the operating pulse signal, $$\frac{i-1}{l}$$

is the delay time interval between two neighboring rows, l is the number of the light-emitting diode rows. Referring to FIG. 1 together, the light-emitting diode array can be composed by upper n number of light-emitting diode columns and lower n number of light-emitting diode columns, correspondingly l is equal to 2 m, but not limited by the embodiment.

Figure 4B:
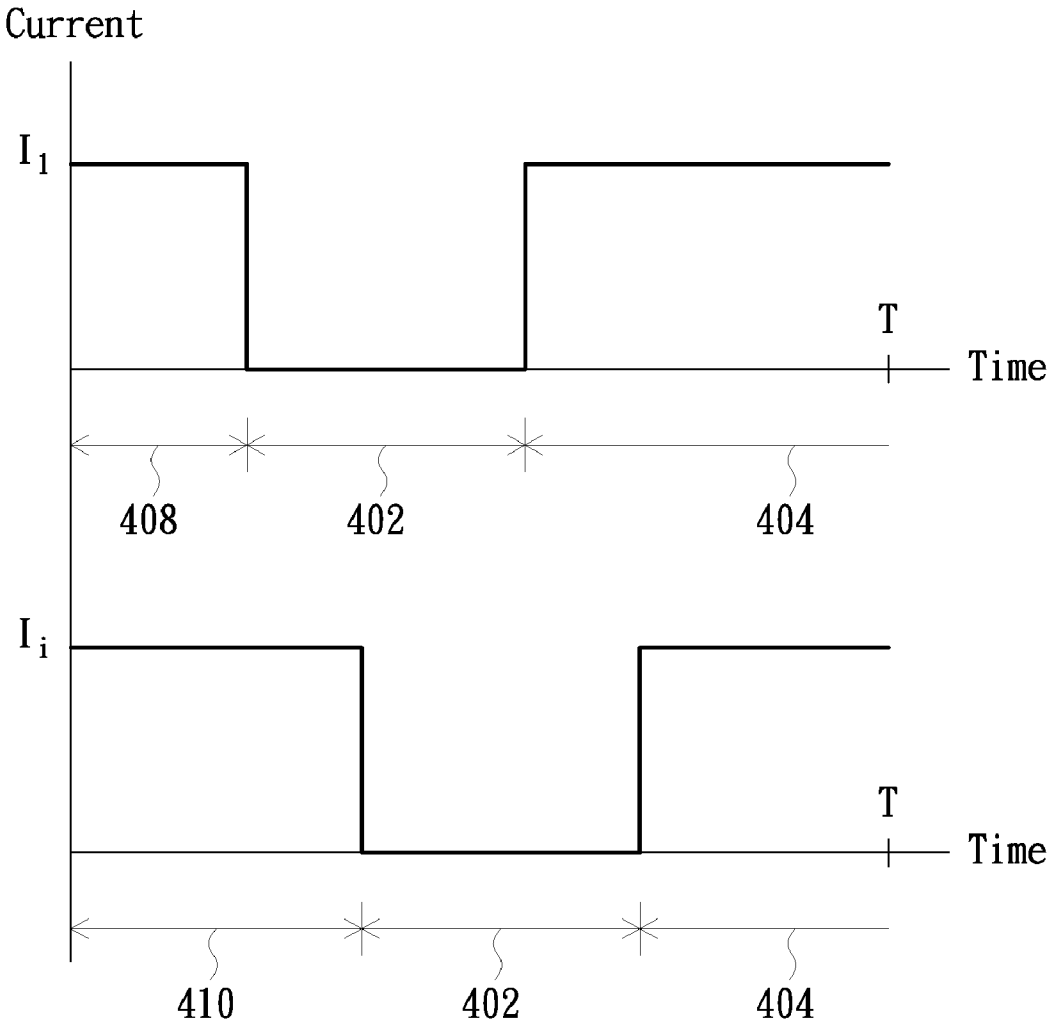
FIG. 4B shows time-current relationship diagrams of operating pulse signals of two neighboring light-emitting diodes in accordance with another embodiment of the present invention.

Referring to FIG. 4B, showing time-current relationship diagrams of the operating pulse signals of two neighboring light-emitting diodes arranged in different rows in accordance with another embodiment of the present invention. The difference between FIG. 4A and FIG. 4B is that: the operating pulse signals as shown in FIG. 4B has an additional liquid crystal transition delay time interval ScanDel, i.e., the time interval 408 as shown in FIG. 4B. The definitions of the time intervals 402 and 404 are the same as that in FIG. 4A. However, the time intervals 408 and 410 should not be included in the calculation of the operating current values of the light-emitting diodes, wherein the time interval 410 is the sum of the time intervals 406 and 408. Therefore, when calculating the operating current values, the time intervals 408 and 410 should be deducted from the sampling time points applied to the respective operating pulse signals. Accordingly, based on the relationship as shown in FIG. 4B, a time function of the operating current value is calculated by the following expression:

$$I_{LED_i(t)} = \text{Duty}\left(t - \frac{i-1}{l} - ScanDel\right) \times I_{LED_i}$$

Where, $I_{LED}$ is an operating current value, i is the serial number of the light-emitting diode, t is the sampling time point applied to the operating current pulse, $$\frac{i-1}{l}$$

is the delay time interval between neighboring rows, l is the number of the light-emitting diode rows, ScanDel is the international standard liquid crystal transition delay time interval. Referring to FIG. 1 together, the light-emitting diode array can be composed by upper n number of light-emitting diode columns and lower n number of light-emitting diode columns, correspondingly l is equal to 2 m, but not limited by the embodiment.

Figure 5:
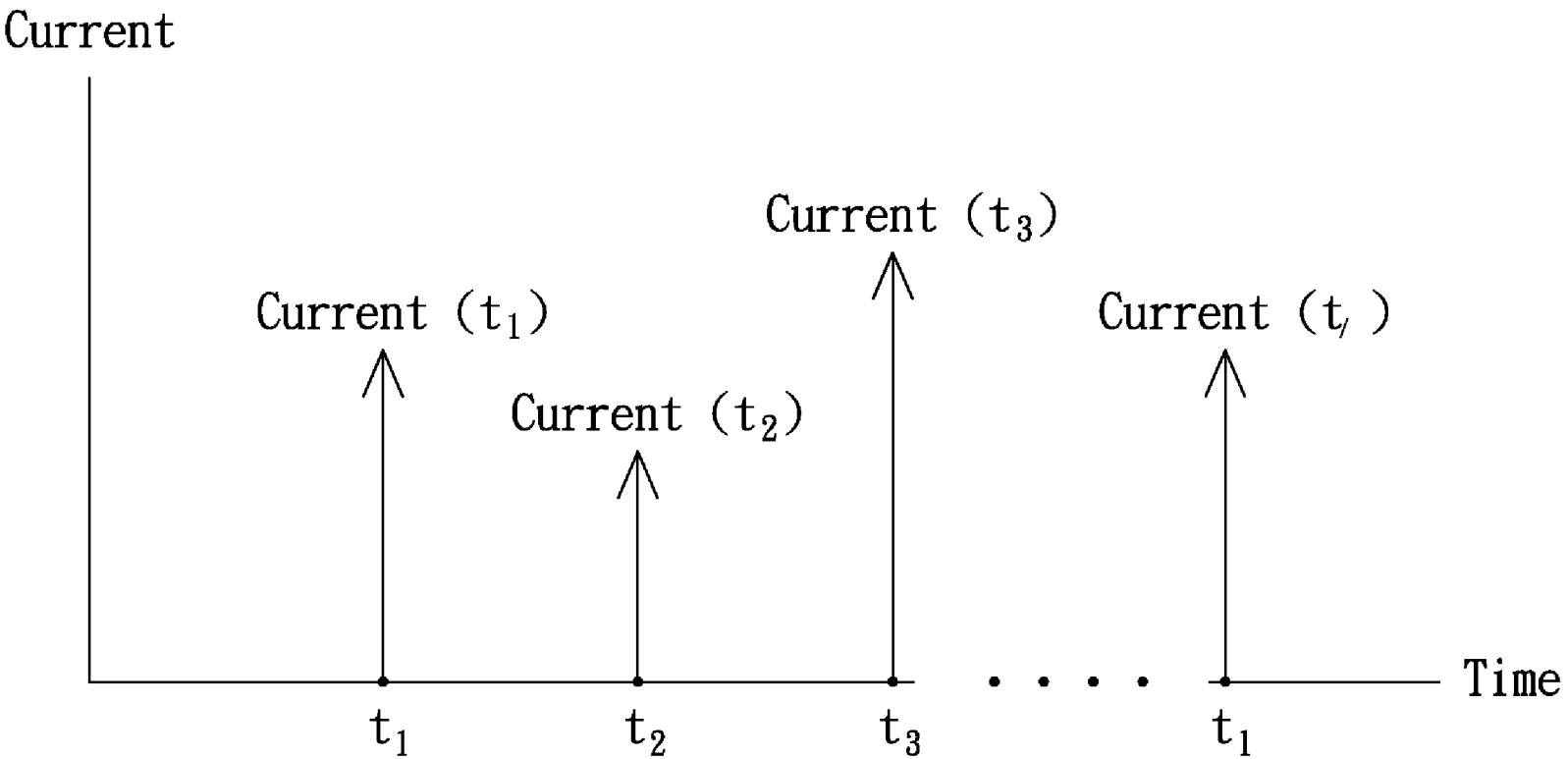
FIG. 5 shows a time-current relationship diagram of operating pulse signals of a single light-emitting diode column in accordance with an embodiment of the present invention.

Referring to FIG. 5, showing a time-current relationship diagram of the operating pulse signals of a single light-emitting diode column in accordance with an embodiment of the present invention. As far as each the light-emitting diode column in FIG. 1 is concerned, the current sensor 104 detects a plurality of overall current values at the different timings. In the illustrated embodiment, for example, at the sampling time point t1, the overall current value is only the operating current value of the enabled first light-emitting diode $LED_1$; at the sampling time point t2, the overall current value is the sum of the operating current values of the enabled first light-emitting diode $LED_1$ and second light-emitting diode $LED_2$. Following by analogy, at the time point $t_l$, the overall current values is the sum of the operating current values of the enabled first through lth light-emitting diodes. Therefore, based on the relationship as shown in FIG. 5, a time function of the overall current value is calculated by the following expression:

$$\begin{aligned}\text{Current}(t_k) &= \sum_{i=1}^{m} I_{LED_i}(t_k) \\ &= I_{LED_1}(t_k) + I_{LED_2}(t_k) + \ldots + \\ &\quad I_{LED_m}(t_k)\end{aligned}$$

Where, k is ranged from 1 to l. Thus, taking the illustration in FIG. 1 as an example, the light-emitting adjuster 108 can obtain the overall current value, an objective(s) being enabled in the light-emitting diodes, and an amount of enabled light-emitting diode in each of the light-emitting diode columns $L_1$-$L_n$, at each sampling/sensing time point, and then substitutes the overall current values, the corresponding enabled objectives and the corresponding amounts of the enabled light-emitting diode into a plurality of multinomials. Afterward, the operating current value of each light-emitting diode is obtained after performing a matrix operation applied to the multinomials.

Figure 6:
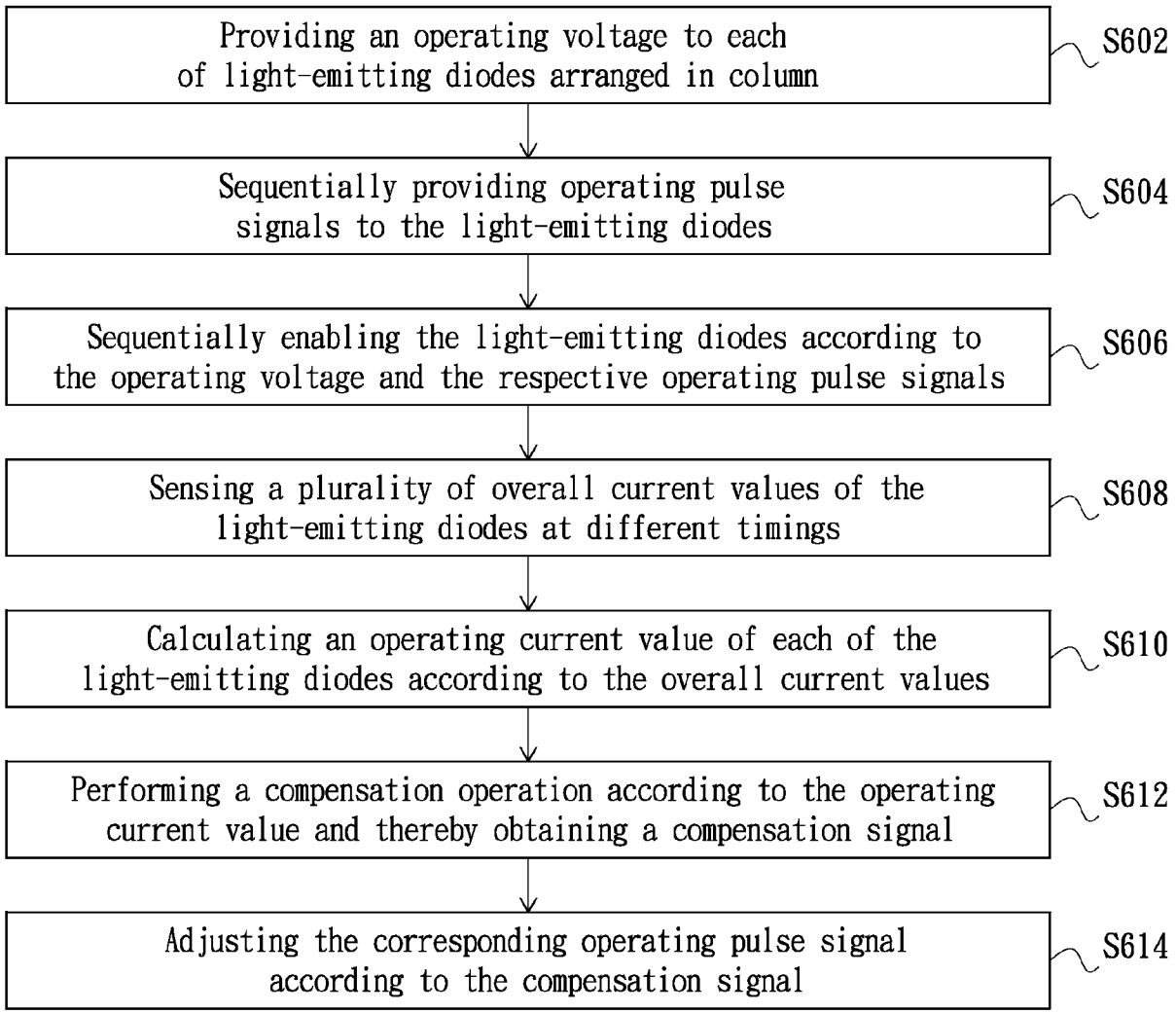
FIG. 6 shows a flowchart of a light-emitting adjustment method in an embodiment of the present invention.
Figure 7:
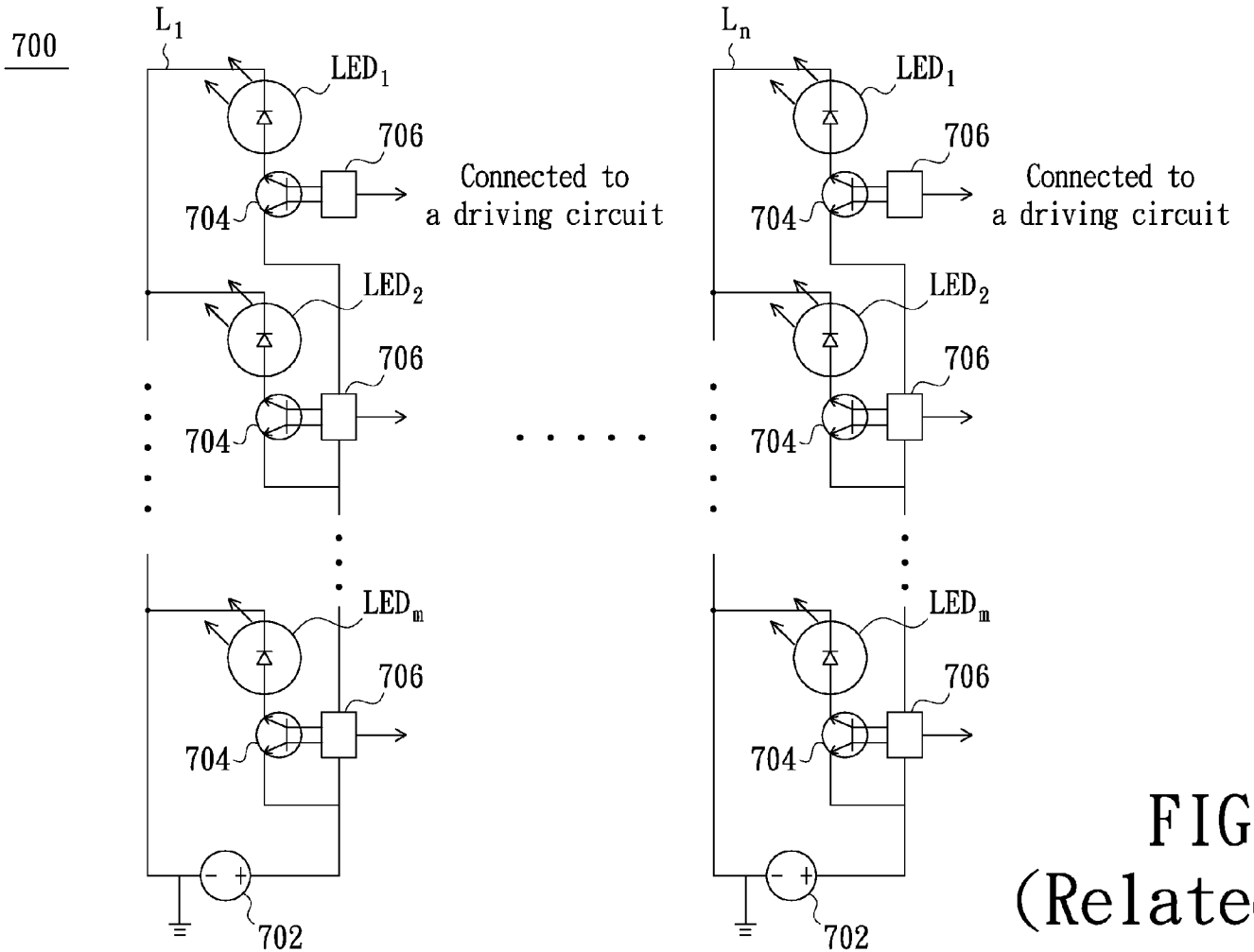
FIG. 7 (Related Art)
FIG. 7 shows a circuit diagram of a display device in the prior art.

Referring to FIG. 6, showing a flowchart of a light-emitting adjustment method in accordance with an embodiment of the present invention. Referring to FIGS. 1 and 6 together, in the illustrated embodiment, in step S602, the voltage source 102 in each column provides an operating voltage to the m number of light-emitting diodes $LED_1$~$LED_m$ that electrically connected thereto. The pulse width modulator 106 performs a calculation operation to obtain the delay time interval between neighboring rows determined by the number/amount of the light-emitting diode rows and a frame period. Thus, in step S604, the pulse width modulator 106 sequentially outputs operating pulse signals with the delay time interval to the light-emitting diodes $LED_1$~$LED_m$, herein the operating pulse signal provided to the light-emitting diode LED1 is unnecessarily given the delay time interval. In step S606, each of the light-emitting diode receives a corresponding operating pulse signal, and the operating voltage is allowed to be provided on the light-emitting diode during the operating pulse signal being logic high so as to enable the light-emitting diode.

In step S608, during the light-emitting diodes $LED_1$~$LED_m$ are sequentially enabled, the current sensor 104 continuously senses the overall current values of each the light-emitting diode columns $L_1$~$L_n$, obtains the enabled objectives at respective timings, and the amounts of enabled light-emitting diode at the respective timings based on a built-in database, converts the overall current values from analog format to digital format, and outputs the converted overall current values to the light-emitting adjuster 108.

In step S610, in a frame period, the light-emitting adjuster 108 would receive a plurality of overall current values in succession and obtains corresponding enabled objectives at the different timings and corresponding amounts of enabled light-emitting diode at the different timings, and then substitute the overall current values, the enabled objectives and the amounts of enabled light-emitting diode into a plurality of multinomials stored in the light-emitting adjuster 108. The light-emitting adjuster 108 further performs a matrix operation applied to the multinomials, and thereby obtains the operating current value of each light-emitting diode.

In step S612, the light-emitting adjuster 108 obtains a compensation signal through comparing each the operating current value with a reference current value, and outputs the compensation signal to the pulse width modulator 106. When the operating current value is larger than the reference current value, the compensation signal is used for shortening the duty cycle of the operating pulse signal. On contrary, when the operating current value is smaller than the reference current value, the compensation signal is used for prolonging the duty cycle of the operating pulse signal. In step S614, the pulse width modulator 106 adjusts the operating pulse signals for the light-emitting diodes based on the compensation signals and sequentially outputs the adjusted operating pulse signals.

In the illustrated embodiment, the reference current value can be built up by the manufacturer of the display device 100 and stored in the light-emitting adjuster 108 or a memory (not shown) of the display device 100, but not limited the present invention.

In summary, the light-emitting adjustment method and the display device in accordance with the present invention can reduce the number of current sensor, and thus cost is decreased. In addition, since the embodiments establish light-emitting time intervals among the m number of light-emitting diodes in each light-emitting diode column, current compensation values of the respective light-emitting diodes can be readily obtained by a compensation operation performed after sensing and recording overall current values of each column of light-emitting diodes of the backlight of the display device or the display device and then calculating the operating current value of each light-emitting diodes according to the overall current values. Consequently, the light-emitting diodes can be driven by the respective compensation values to achieve the purpose of brightness adjustment.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A light-emitting adjustment method adapted for a light-emitting diode array, wherein the light-emitting diode array comprises n number of light-emitting diode columns, and each of the light-emitting diode columns comprises m number of light-emitting diodes connected in parallel to constitute a light-emitting area, n and m both are positive integers, the light-emitting adjustment method comprising:

providing an operating voltage to the m number of light-emitting diodes;

sequentially providing operating pulse signals to the m number of light-emitting diodes;

sequentially enabling the m number of light-emitting diodes based on the operating voltage and the respective operating pulse signals, and sensing a plurality of overall current values of the m number of light-emitting diodes at different timings;

calculating an operating current value of each of the m number of light-emitting diodes based on the overall current values;

performing a compensation operation based on the operating current value and thereby obtaining a compensation signal; and adjusting a corresponding one of the operating pulse signals according to the compensation signal.

2. The light-emitting adjustment method as claimed in claim 1, wherein the step of sensing a plurality of overall current values of the m number of light-emitting diodes at different timings comprises:

during the m number of the light-emitting diodes being sequentially enabled, sensing one of the overall current values, an objective(s) being enabled of the m number of light-emitting diodes and an amount of enabled light-emitting diode in the m number of light-emitting diodes at each of the timings.

3. The light-emitting adjustment method as claimed in claim 2, wherein the step of calculating an operating current value of each of the m number of light-emitting diodes based on the overall current values comprises:

calculating the operating current values of the m number of light-emitting diodes based on the overall current values, corresponding enabled objectives at the respective timings, and corresponding amounts of enabled light-emitting diode at the respective timings.

4. The light-emitting adjustment method as claimed in claim 3, wherein the operating pulse signals of each two neighboring light-emitting diodes arranged different rows in each of the light-emitting diode columns has a delay time interval given therebetween.

5. The light-emitting adjustment method as claimed in claim 4, wherein the operating pulse signal of each of the m number of light-emitting diodes comprises a liquid crystal transition delay time interval.

6. The light-emitting adjustment method as claimed in claim 5, wherein when calculating the operating current value of each of the m number of light-emitting diodes, a sampling time point of the operating pulse signal would deduct the given delay time interval and the liquid crystal transition delay time interval.

7. The light-emitting adjustment method as claimed in claim 4, wherein the delay time interval is decided by a frame period and the number of rows in each of the light-emitting diode columns.

8. The light-emitting adjustment method as claimed in claim 3, wherein the step of performing a compensation operation based on the operating current value and thereby obtaining a compensation signal comprises:

obtaining the compensation signal by comparing the operating current value with a reference current value;

when the operating current value is larger than the reference current value, the compensation signal is used for shortening a duty cycle of the operating pulse signal; and when the operating current value is smaller than the reference current value, the compensation signal is used for prolonging the duty cycle of the operating pulse signal.

9. The light-emitting adjustment method as claimed in claim 8, wherein the reference current value is a current value representative of dark region brightness.

10. The light-emitting adjustment method as claimed in claim 8, wherein the reference current value is a current value representative of bright region brightness.

11. The light-emitting adjustment method as claimed in claim 8, wherein the reference current value is a current value representative of target brightness.

12. A display device, comprising:

a voltage source for providing an operating voltage;

a light-emitting diode array comprising n number of light-emitting diode columns, wherein each of the light-emitting diode columns comprises m number of light-emitting diodes electrically connected in parallel and further electrically connected to the voltage source for receiving the operating voltage, n and m both are positive integers;

a pulse width modulator electrically connected to the m number of light-emitting diodes and used for sequentially providing operating pulse signal to the m number of light-emitting diodes;

at least a current sensor being electrically connected between a voltage output terminal of the voltage source and a voltage input terminal of the m number of light-emitting diodes in each of the light-emitting diode columns and for sensing a plurality of overall current values of the m number of light-emitting diodes at different timings during the m number of light-emitting diodes are sequentially enabled; and a light-emitting adjuster electrically connected to the current sensor and the pulse width modulator, wherein the light-emitting adjuster is for calculating an operating current value of each of the m number of light-emitting diodes according to the overall current values, performing a compensation operation according to the operating current value and thereby outputting a compensation signal.

13. The display device as claimed in claim 12, wherein the light-emitting adjuster calculates the operating current value of each of the m number of light-emitting diodes based on the overall current values, corresponding objectives being enabled in the m number of light-emitting diodes at the respective timings and corresponding amounts of enabled light-emitting diode in the m number of light-emitting diodes at the respective timings.

14. The display device as claimed in claim 12, wherein the operating pulse signal of each two neighboring light-emitting diodes arranged at different rows in each of the light-emitting diode columns are given a delay time interval therebetween.

15. The display device as claimed in claim 14, wherein the operating pulse signal of each of the m number of light-emitting diodes in each of the light-emitting diode columns comprises a liquid crystal transition delay time interval.

16. The display device as claimed in claim 14, wherein the delay time interval between is decided by a frame period of the display device and the number of rows in each of the light-emitting diode columns.

17. The display device as claimed in claim 12, wherein the compensation operation is performed to obtain the compensation signal by comparing the operating current value and a reference current value.

18. The display device as claimed in claim 17, wherein when the operating current value is larger than the reference current value, a duty cycle of the operating pulse signal provided by the pulse width modulator is shortened.

19. The display device as claimed in claim 17, wherein when the operating current value is smaller than the reference current value, a duty cycle of the operating pulse signal provided by the pulse width modulator is prolonged.

20. The display device as claimed in claim 17, wherein the reference current value is a current value representative of dark region brightness.

21. The display device as claimed in claim 17, wherein the reference current value is a current value representative of bright region brightness.

22. The display device as claimed in claim 17, wherein the reference current value is a current value representative of target brightness.

23. The display device as claimed in claim 12, wherein when calculating the operating current value of each the light-emitting diode, a sampling time point of the operating pulse signal would deduct the given delay time interval and the liquid crystal transition delay time interval.

* * * * *